US009255680B2

(12) United States Patent
Yasuda

(10) Patent No.: US 9,255,680 B2
(45) Date of Patent: Feb. 9, 2016

(54) TRANSPORTATION DEVICE LAMP FIXTURE

(71) Applicant: KOITO MANUFACTURING CO., LTD., Minato-ku, Tokyo (JP)

(72) Inventor: Yuji Yasuda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 13/912,685

(22) Filed: Jun. 7, 2013

(65) Prior Publication Data

US 2013/0329443 A1 Dec. 12, 2013

(30) Foreign Application Priority Data

Jun. 11, 2012 (JP) ..... 2012-131536

(51) Int. Cl.
*F21S 8/10* (2006.01)

(52) U.S. Cl.
CPC ..... *F21S 48/10* (2013.01); *F21S 48/1104* (2013.01); *F21S 48/1159* (2013.01); *F21S 48/1305* (2013.01); *F21S 48/215* (2013.01); *F21S 48/232* (2013.01); *F21S 48/321* (2013.01); *F21S 48/328* (2013.01)

(58) Field of Classification Search
CPC ..... F21Y 2101/02; B62J 6/02; F21K 9/00; F21K 9/30; F21K 9/52; Y10S 362/80; F21S 48/115; F21S 48/10; F21S 48/321; F21S 48/1159; F21S 48/1305; F21S 48/215; F21S 48/1104; F21S 48/232; F21S 48/328; F21V 7/0008; B60Q 11/005; B60Q 1/0094; B60Q 1/2607; B60Q 1/28; B65D 43/02
USPC ..... 362/475, 218, 227, 230, 294, 476, 487, 362/613; 348/148, 118
See application file for complete search history.

(56) References Cited

U.S. PATENT DOCUMENTS

2007/0091632 A1* 4/2007 Glovatsky et al. ..... 362/547
2009/0262549 A1 10/2009 Inoue et al.

FOREIGN PATENT DOCUMENTS

CN 201143906 Y 11/2008
CN 101387378 A 3/2009
CN 101566301 A 10/2009
CN 101592301 A 12/2009
CN 102374465 A 3/2012

(Continued)

OTHER PUBLICATIONS

Communication dated Mar. 13, 2015, issued by the State Intellectual Property Office of the People's Republic of China in counterpart Application No. 201310225010.0.

(Continued)

*Primary Examiner* — Stephen F Husar
*Assistant Examiner* — Danielle Allen
(74) *Attorney, Agent, or Firm* — Sughrue Mion, PLLC

(57) ABSTRACT

A transportation device lamp fixture includes a semiconductor light-emitting device, a circuit board to which the semiconductor light-emitting device is mounted, a lamp body, and a front cover that covers an opening of the lamp body. The semiconductor light-emitting device and the circuit board are housed inside of a lamp chamber formed by the lamp body and the front cover, and the circuit board is attached to an inside surface of an upper portion of the front cover or the lamp body.

7 Claims, 8 Drawing Sheets

(56) References Cited

FOREIGN PATENT DOCUMENTS

| | | | |
|---|---|---|---|
| EP | 2418121 | A2 | 2/2012 |
| JP | 2005-011704 | A | 1/2005 |
| JP | 2011198757 | A | 10/2011 |

OTHER PUBLICATIONS

Communication dated Aug. 20, 2015 from the State Intellectual Property Office of the P.R.C. in counterpart application No. 201310225010.0.

* cited by examiner

TRANSPORTATION DEVICE LAMP FIXTURE

INCORPORATION BY REFERENCE

The disclosure of Japanese Patent Application No. 2012-131536 filed on Jun. 11, 2012 including the specification, drawings and abstract is incorporated herein by reference in its entirety.

BACKGROUND OF THE INVENTION

1. Field of the Invention

The invention relates to a transportation device lamp fixture, and more particularly, to a transportation device lamp fixture that uses a semiconductor light-emitting device.

2. Description of Related Art

In recent years, single-person transportation devices referred to as personal mobility vehicles have been developed. A personal mobility vehicle is designed to be a mode of transportation that is between walking and existing vehicles, and is proposed as a vehicle that differs from existing vehicles, based on the concept of reducing the amount of energy consumed for personal transportation.

A personal mobility vehicle is small compared to an existing vehicle, so the position in which a lamp fixture is able to be mounted is limited. Therefore, a lamp fixture having a simpler structure than an existing vehicle lamp structure is required.

SUMMARY OF THE INVENTION

The invention thus provides a transportation device lamp fixture having a simplified structure.

One aspect of the invention relates to a transportation device lamp fixture that includes a semiconductor light-emitting device, a circuit board to which the semiconductor light-emitting device is mounted, a lamp body, and a front cover that covers an opening of the lamp body. The semiconductor light-emitting device and the circuit board are housed inside of a lamp chamber formed by the lamp body and the front cover. The circuit board is attached to an inside surface of an upper portion of the front cover or an inside surface of an upper portion of the lamp body.

According to the transportation device lamp structure of the invention, the circuit board is provided on the inside surface of the upper portion of the front cover or the lamp body, which obviates the need to provide a separate member for supporting the circuit board. As a result, the structure of the lamp fixture is able to be simplified.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, example embodiments of the invention will now be described in detail with reference to the accompanying drawings.

Figure 1:
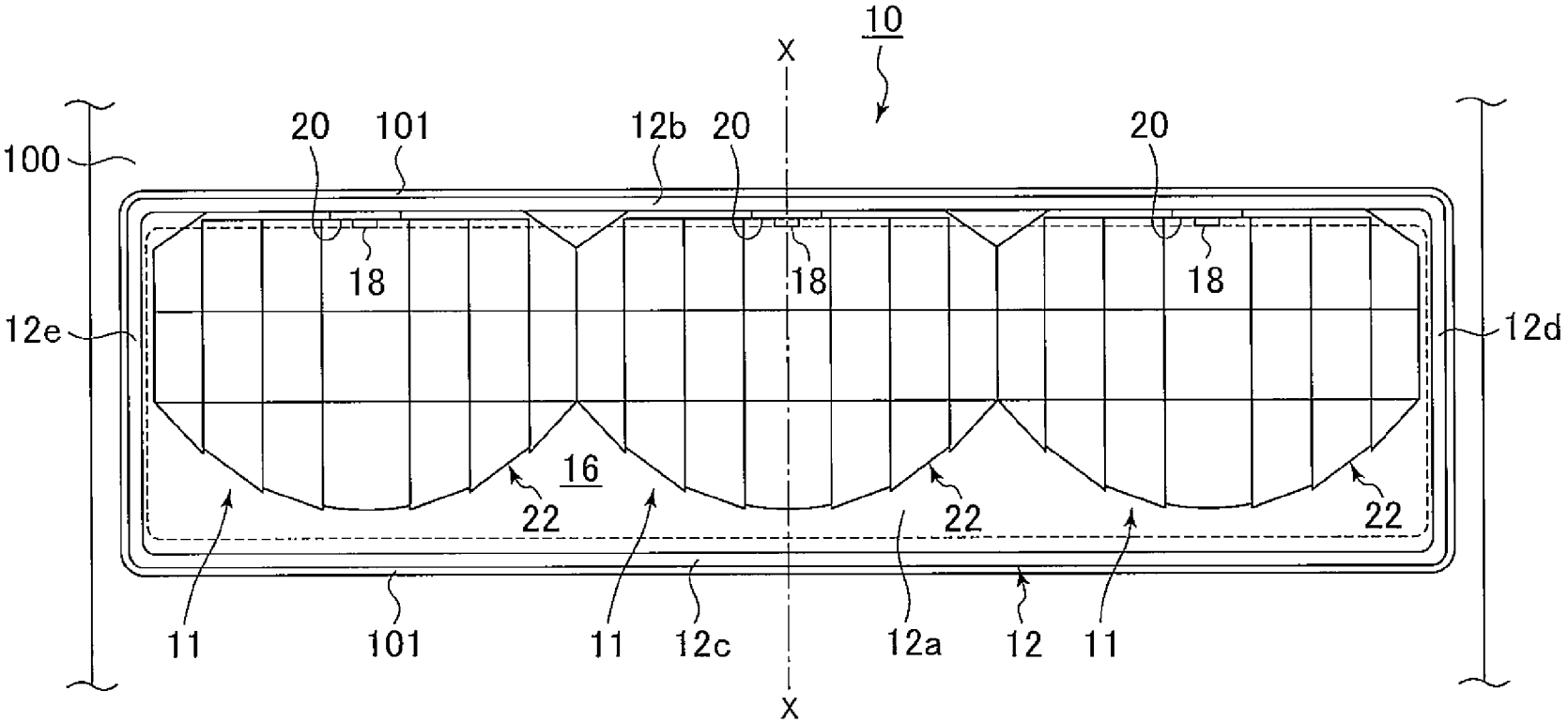
FIG. 1 is a front view of a transportation device lamp fixture according to one example embodiment of the invention.
Figure 2:
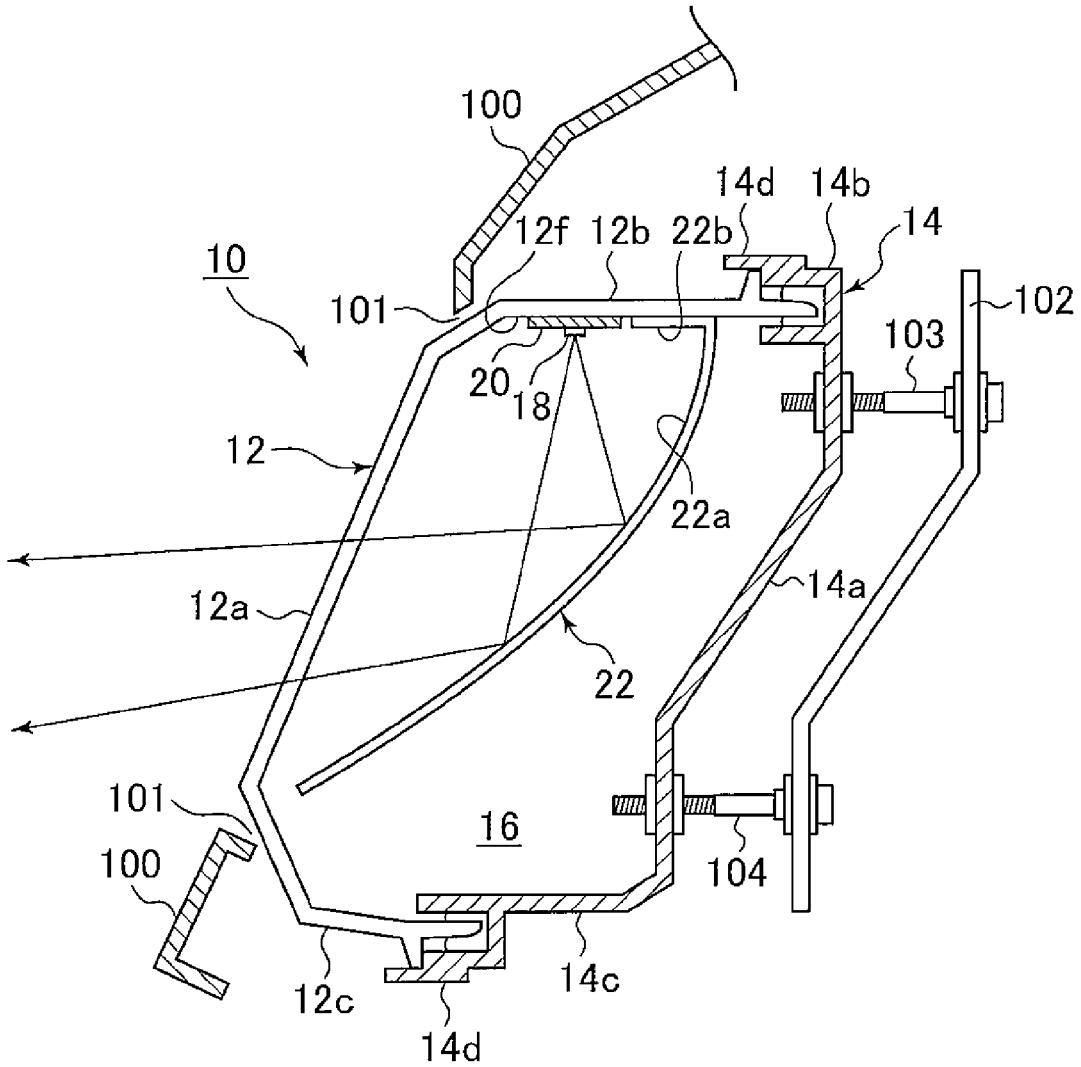
FIG. 2 is a sectional view taken along line X-X of the transportation device lamp fixture shown in FIG. 1.

FIG. 1 is a front view of a transportation device lamp fixture 10 according to one example embodiment of the invention. FIG. 2 is a sectional view (a vertical sectional view) taken along line X-X of the transportation device lamp fixture 10 shown in FIG. 1. The transportation device lamp fixture 10 shown in FIGS. 1 and 2 is a headlamp provided at the front of a transportation device such as a personal mobility vehicle, for example. Therefore, in the example embodiments below, the term "vehicle" will be used instead of the term "transportation device" for simplicity.

The vehicle lamp fixture 10 includes a lamp body 14 that has a recessed portion that is open toward the front of the lamp fixture, and a transparent front cover 12 that covers the open portion of the lamp body 14. The lamp body 14 and the front cover 12 together form a lamp chamber 16.

The front cover 12 is a member having a sectional recessed shape that is formed by injection molding transparent resin such as acrylic or polycarbonate, and mainly includes a front portion 12*a* that faces forward of the vehicle, an upper portion 12*b* that extends horizontally rearward from an upper end portion of the front portion 12*a*, a bottom portion 12*c* that extends rearward from a lower end portion of the front portion 12*a*, a left side portion 12*d* that extends rearward from a left end portion of the front portion 12*a*, and a right side portion 12*e* that extends rearward from a right end portion of the front portion 12*a*.

In this example embodiment, when the vehicle lamp fixture 10 is mounted to the vehicle, the front portion 12*a* or only a portion of the front portion 12*a* of the front cover 12 is exposed on the outside of the vehicle. That is, the front portion 12*a* or only a portion thereof is exposed to the outside through a hole 101 provided in a hood member 100 that is positioned at the front of the vehicle. On the other hand, the upper portion 12*b* and the bottom portion 12*c* are covered by the hood member 100, so the upper portion 12*b*, the bottom portion 12*c*, the left side portion 12*d*, and the right side portion 12*e* are not easily visually recognizable from the outside. The hood member 100 may be a front cowl, a bumper, or a bonnet (hood) or the like of the vehicle.

The lamp body 14 is formed in a container shape that is open at the front. The lamp body 14 mainly includes a back portion 14*a* that faces the front portion 12*a* of the front cover 12, an upper portion 14*b* that extends forward from an upper end portion of the back portion 14*a*, a bottom portion 14*c* that extends forward from a lower end portion of the back portion 14*a*, a left side portion, not shown, that extends forward from a right end portion of the back portion 14*a*, and a right side portion, also not shown, that extends forward from a right end portion of the back portion 14*a*. The lamp body 14 may be formed using polypropylene resin, for example. A joining portion 14*d* for joining and fixing the front cover 12 to the lamp body 14 is provided on tip end portions of the upper portion 14*b*, the bottom portion 14*c*, the left side portion, and the right side portion of the lamp body 14.

The vehicle lamp fixture 10 is supported on the vehicle via a first aiming screw 103 and a second aiming screw 104. One end portion of the first aiming screw 103 and the second aiming screw 104 is attached to the back portion 14*a* of the lamp body 14, and the other end portion of the first aiming screw 103 and the second aiming screw 104 is attached to a lamp supporting portion 102 of the vehicle. The posture of the vehicle lamp fixture 10 is able to be changed by turning the first aiming screw 103 and the second aiming screw 104, which enables the aim of the vehicle lamp fixture 10 to be adjusted when the vehicle is shipped or inspected, for example.

As shown in FIG. 1, three lamp fixture units 11 are housed in the lamp chamber 16. These three lamp fixture units 11 are arranged lined up in a vehicle width direction. The structure of each of these lamp fixture units 11 is the same. Each lamp fixture unit 11 includes an LED 18, a circuit board 20 to which the LED is mounted and that supplies power to the LED 18, and a reflector 22 that reflects light emitted from the LED 18 in front of the lamp fixture.

In this example embodiment, the circuit board 20 to which the LED 18 is mounted is directly mounted onto an inside surface 12*f* of the upper portion 12*b* of the front cover 12. The circuit board 20 is arranged such that a light-emitting surface of the LED 18 faces vertically downward. The LED 18 that is mounted on the circuit board 20 may be a white LED with a wattage of approximately 1 W, for example. Also, a plurality of LEDs 18 may be mounted on the circuit board 20.

The method by which the circuit board 20 is fixed to the upper portion 12*b* is not particularly limited. That is, the circuit board 20 may be fastened by a screw or fixed by adhesive or the like. Alternatively, a pin may be provided on the inside surface 12*f* of the upper portion 12*b*, and the circuit board 20 may be fixed to the upper portion 12*b* by fitting the pin into a hole provided in the circuit board 20, and then thermally caulking the pin. In this case, a fixing member such as a screw is not necessary, so the number of parts, as well as the assembly time, can be reduced.

The reflector 22 has a reflective portion 22*a* for reflecting the light that is emitted from the LED 18, and an attaching portion 22*b* for attaching the reflector 22 to the front cover 12. In this example embodiment, the attaching portion 22*b* of the reflector 22 is directly attached onto the inside surface 12*f* of the upper portion 12*b* of the front cover 12, similar to the circuit board 20. The method by which the reflector 22 is fixed to the upper portion 12*b* is not particularly limited. That is, the reflector 22 may be fastened by a screw, fixed by adhesive, or thermally caulked, or the like.

The reflective portion 22*a* of the reflector 22 reflects the light emitted downward from the LED 18 so that it is irradiated in front of the lamp fixture, as shown in FIG. 2. The shape of the reflective portion 22*a* is suitably designed according to the vehicle in which it is mounted, such that the reflected light creates a desired light distribution pattern.

Above, the structure of the vehicle lamp fixture 10 according to this example embodiment is described. In the vehicle lamp fixture 10, the circuit board 20 to which the LED 18 is mounted is directly attached onto the inside surface 12*f* of the upper portion 12*b* of the front cover 12. Employing this kind of structure obviates the need to provide a separate member for supporting the circuit board 20, so the structure of the lamp fixture is able to be simplified. As a result, it is possible to reduce the number of parts and lower the cost, as well as make the lamp fixture lighter and smaller.

A small vehicle such as a personal mobility vehicle on which the vehicle lamp fixture 10 according to this example embodiment is mounted is very energy efficient, so the amount of exhaust heat from the radiator is small. In addition, in many cases there is usually no air-conditioner, so there is also no air-conditioner exhaust heat. That is, in a small vehicle such as a personal mobility vehicle, there is no other large heat source in the position where the vehicle lamp fixture 10 is mounted. Therefore, the environment temperature of the lamp fixture is equal to the outside air temperature plus approximately several degrees. Also, with a small vehicle, the required light distribution is not as high as it is with an existing vehicle, so several LEDs of low wattage, such as approximately 1 W, for example, are sufficient. Therefore, the upper temperature limit of the LED 18 is able to be sufficiently satisfied even if the circuit board 20 is attached to the upper portion 12*b* of the front cover 12 without a heat sink.

Also, with the vehicle lamp fixture 10 according to this example embodiment, the circuit board 20 to which the LED 18 is mounted, and the reflector 22 are both attached to the upper portion 12*b* of the front cover 12. Attaching the circuit board 20 and the reflector 22 to a common member in this way makes it easier to position the LED 18 and the reflector 22, so the assembly time can be reduced and the optical precision can be improved.

Further, with the vehicle lamp fixture 10 according to this example embodiment, the circuit board 20 is provided on the inside surface 12*f* of the upper portion 12*b* of the front cover 12, and the light-emitting surface of the LED 18 faces vertically downward. If the circuit board 20 were provided on the inside surface of the bottom portion 14*c* of the front cover 12, the light-emitting surface of the LED 18 would face vertically upward, but in this case, direct light from the LED 18 might become glare light. The production of such glare light is able to be avoided with the vehicle lamp fixture 10 according to this example embodiment.

Figure 3:
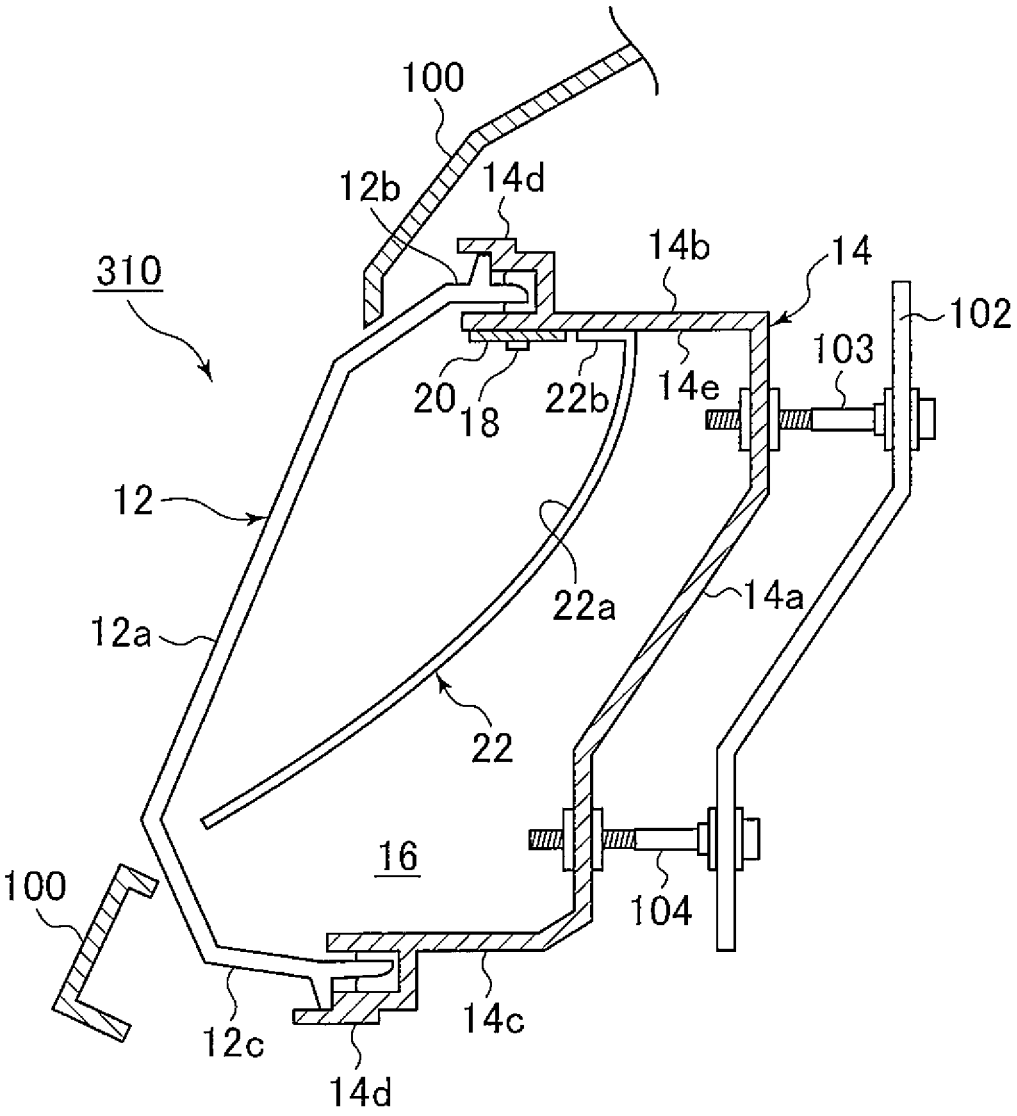
FIG. 3 is a sectional view of a transportation device lamp fixture according to another example embodiment of the invention.

FIG. 3 is a sectional view of a vehicle lamp fixture 310 according to another example embodiment of the invention. Constituent elements of this vehicle lamp fixture 310 that are similar or correspond to constituent elements of the vehicle lamp fixture 10 shown in FIGS. 1 and 2 will be denoted by like reference characters and redundant descriptions of those elements will be appropriately omitted.

With the vehicle lamp fixture 310 according to this example embodiment, and the circuit board 20 to which the LED 18 is mounted, and the reflector 22 are attached directly onto an inside surface 14*e* of the upper portion 14*b* of the lamp body 14. The method by which circuit board 20 and the reflector 22 are fixed to the upper portion 14*b* is not particularly limited. That is, the circuit board 20 and the reflector 22 may be fastened by a screw, fixed by adhesive, or thermally caulked, or the like.

With this kind of structure as well, there is no need to provide a separate member for supporting the circuit board 20, so the structure of the lamp fixture is able to be simplified. Also, the circuit board 20 to which the LED 18 is mounted, and the reflector 22 are both attached to the upper portion 14*b* of the lamp body 14, which makes it easier to position the LED 18 and the reflector 22, so the assembly time can be reduced and the optical precision can be improved.

Figure 4:
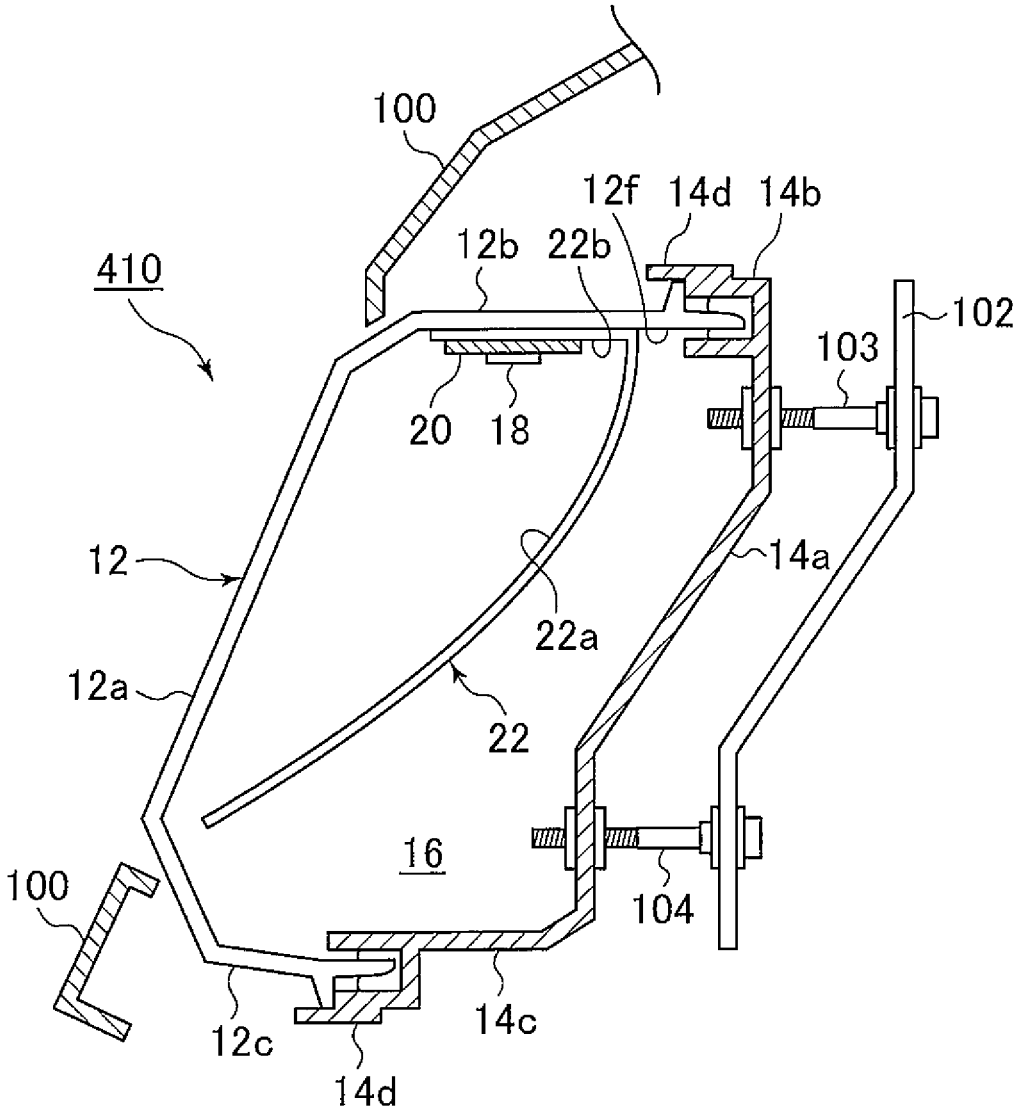
FIG. 4 is a sectional view of a transportation device lamp fixture according to yet another example embodiment of the invention.

FIG. 4 is a sectional view of a vehicle lamp fixture 410 according to yet another example embodiment of the invention. Constituent elements of this vehicle lamp fixture 410 that are similar or correspond to constituent elements of the vehicle lamp fixture 10 shown in FIGS. 1 and 2 will also be denoted by like reference characters and redundant descriptions of those elements will be appropriately omitted.

With the vehicle lamp fixture 410 according to this example embodiment, the circuit board 20 to which the LED 18 is mounted is attached to the inside surface 12*f* of the upper portion 12*b* of the front cover 12 via the attaching portion 22*b* of the reflector 22. That is, the circuit board 20 is attached to the inside surface 12*f* of the upper portion 12*b* of the front cover 12, with the attaching portion 22*b* of the reflector 22 sandwiched in between. The method by which the circuit board 20 and the reflector 22 are fixed to the upper portion 14*b* is not particularly limited. That is, the circuit board 20 and the reflector 22 may be fastened by a screw, fixed by adhesive, or thermally caulked, or the like.

With this kind of structure as well, there is no need to provide a separate member for supporting the circuit board 20, so the structure of the lamp fixture is able to be simplified. As a result, it is possible to reduce the number of parts and lower the cost, as well as make the lamp fixture lighter and smaller. Also, the circuit board 20 on which the LED 18 is mounted, and the reflector 22 are both attached to the upper portion 12*b* of the front cover 12, which makes it easier to position the LED 18 and the reflector 22, so the assembly time can be reduced and the optical precision can be improved.

Moreover, with the vehicle lamp fixture 410 according to this example embodiment, the attaching portion 22*b* of the reflector 22 functions as a heat sink by being sandwiched between the circuit board 20 and the upper portion 12*b* of the front cover 12, so the heat generated by the LED 18 is able to be better dissipated. To achieve this, the reflector 22 or at least the attaching portion 22*b* of the reflector 22 is preferably made of material having a good heat dissipation quality such as metal.

Figure 5:
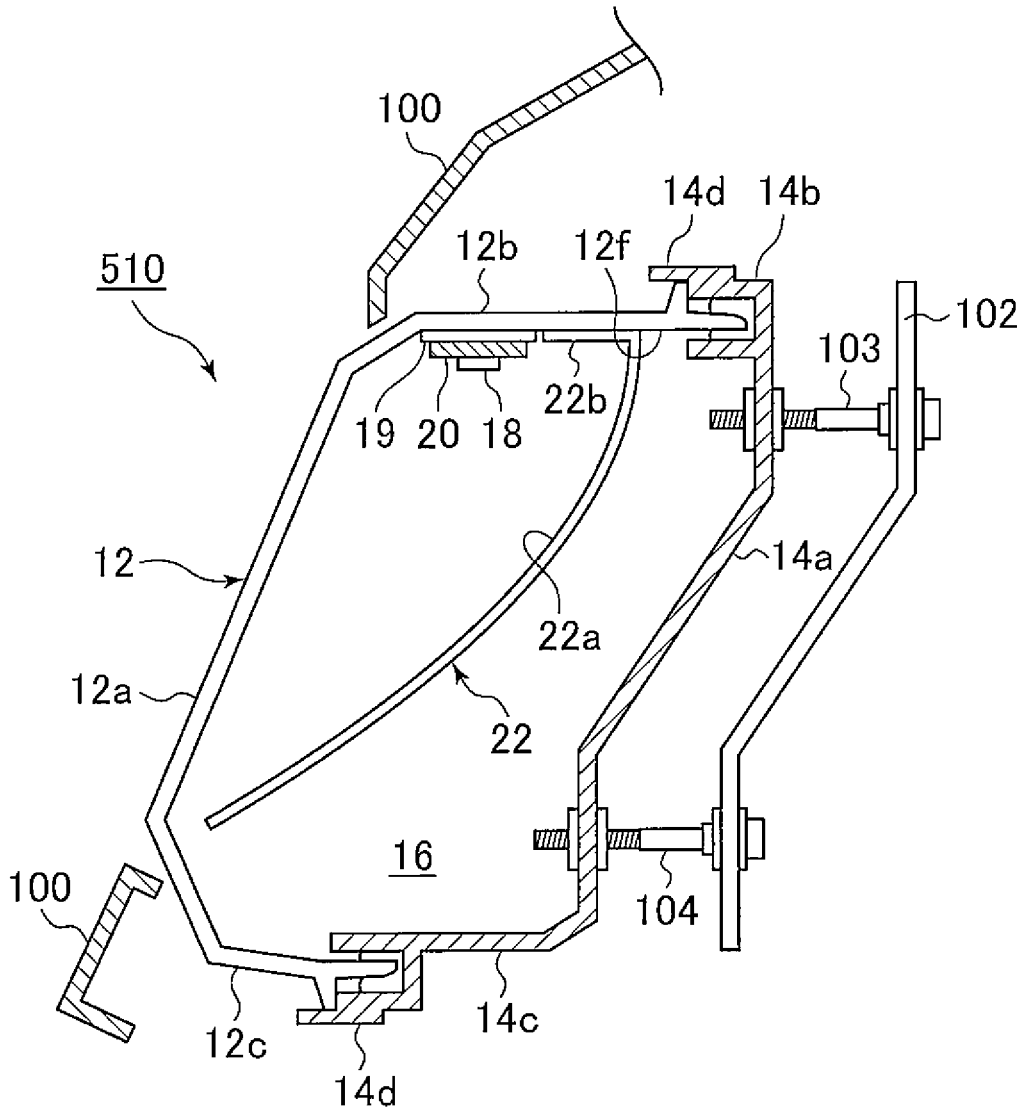
FIG. 5 is a sectional view of a transportation device lamp fixture according to still another example embodiment of the invention.

FIG. 5 is a sectional view of a vehicle lamp fixture 510 according to still another example embodiment of the invention. Constituent elements of this vehicle lamp fixture 510 that are similar or correspond to constituent elements of the vehicle lamp fixture 10 shown in FIGS. 1 and 2 will also be denoted by like reference characters and redundant descriptions of those elements will be appropriately omitted.

With the vehicle lamp fixture 510 according to this example embodiment, the circuit board 20 on which the LED 18 is mounted is attached to the inside surface 12*f* of the upper portion 12*b* of the front cover 12 via a metal plate 19. That is, the circuit board 20 is attached to the inside surface 12*f* of the upper portion 12*b* of the front cover 12, with the metal plate 19 sandwiched in between. The method by which the circuit board 20 and the metal plate 19 are fixed to the upper portion 14*b* is not particularly limited. That is, the circuit board 20 and the metal plate 19 may be fastened by a screw, fixed by adhesive, or thermally caulked, or the like.

With this kind of structure as well, there is no need to provide a separate member for supporting the circuit board 20, so the structure of the lamp fixture is able to be simplified. As a result, it is possible to reduce the number of parts and lower the cost, as well as make the lamp fixture lighter and smaller. Also, the circuit board 20 to which the LED 18 is mounted, and the reflector 22 are both attached to the upper portion 12*b* of the front cover 12, which makes it easier to position the LED 18 and the reflector 22, so the assembly time can be reduced and the optical precision can be improved.

Moreover, with the vehicle lamp fixture 510 according to this example embodiment, the metal plate 19 functions as a heat sink by being sandwiched between the circuit board 20 and the upper portion 12*b* of the front cover 12, so the heat generated by the LED 18 is able to be better dissipated. The metal plate 19 may also be a member having a function to conduct electricity to the LED 18, such as a bus bar.

Figure 6:
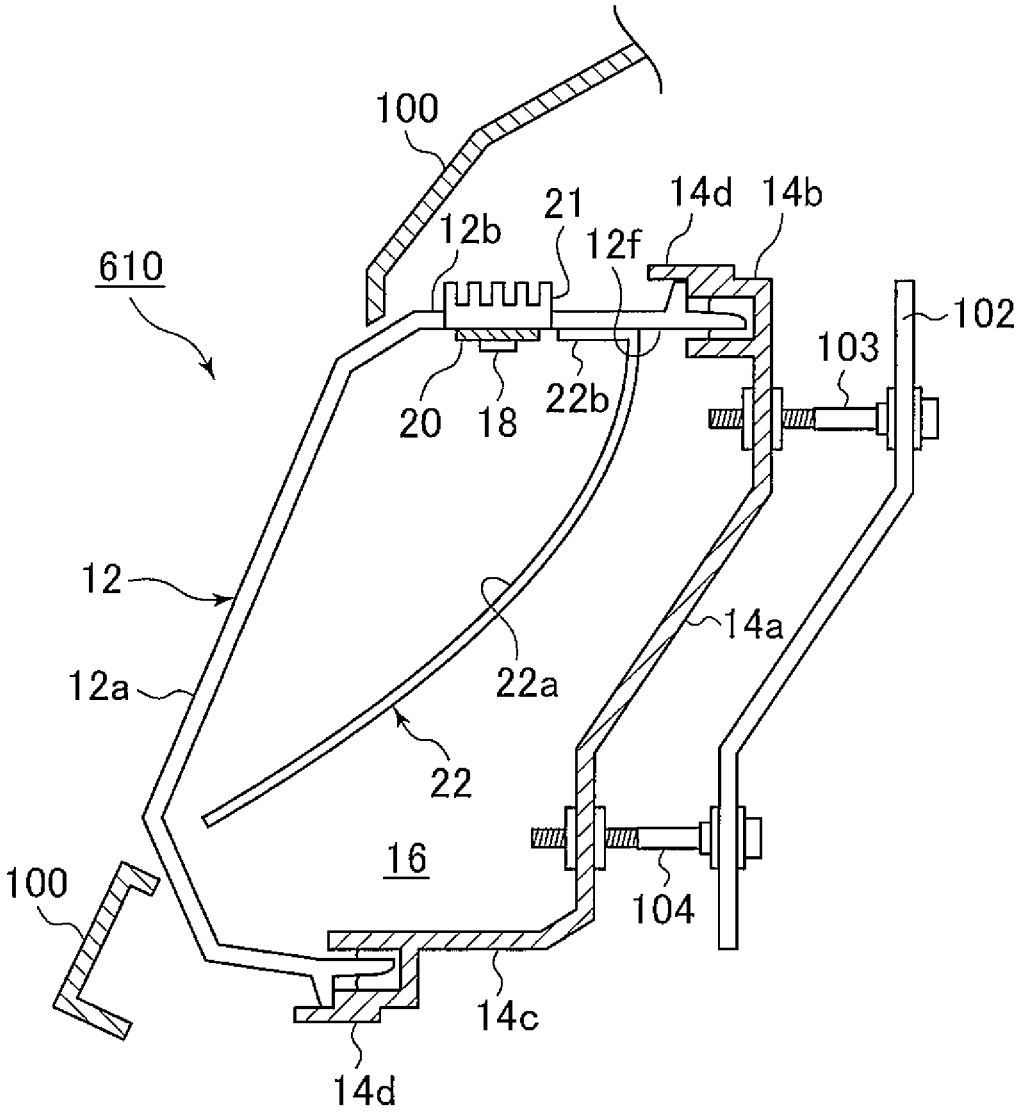
FIG. 6 is a sectional view of a transportation device lamp fixture according to yet another example embodiment of the invention.

FIG. 6 is a sectional view of a vehicle lamp fixture 610 according to yet another example embodiment of the invention. Constituent elements of this vehicle lamp fixture 610 that are similar or correspond to constituent elements of the vehicle lamp fixture 10 shown in FIGS. 1 and 2 will also be denoted by like reference characters and redundant descriptions of those elements will be appropriately omitted.

With the vehicle lamp fixture 610 according to this example embodiment, a metal heat sink 21 is integrally formed on a portion of the upper portion 12*b* of the front cover 12, and the circuit board 20 to which the LED 18 is mounted is attached to this heat sink 21. The heat sink 21 may be integrally formed with the upper portion 12*b* of the front cover 12 using insert molding, for example. The method by which the circuit board 20 is fixed to the heat sink 21 is not particularly limited. That is, the circuit board 20 may be fastened by a screw, fixed by adhesive, or thermally caulked, or the like.

With this kind of structure as well, there is no need to provide a separate member for supporting the circuit board 20, so the structure of the lamp fixture is able to be simplified. As a result, it is possible to reduce the number of parts and lower the cost, as well as make the lamp fixture lighter and smaller. Also, the circuit board 20 to which the LED 18 is mounted, and the reflector 22 are both attached to the upper portion 12*b* of the front cover 12, which makes it easier to position the LED 18 and the reflector 22, so the assembly time can be reduced and the optical precision can be improved.

Furthermore, with the vehicle lamp fixture 610 according to this example embodiment, the circuit board 20 is attached to the heat sink 21 formed on the upper portion 12*b* of the front cover 12, so heat generated by the LED 18 is able to be even better dissipated. As a result, an LED 18 of even higher power can be used.

Figure 7:
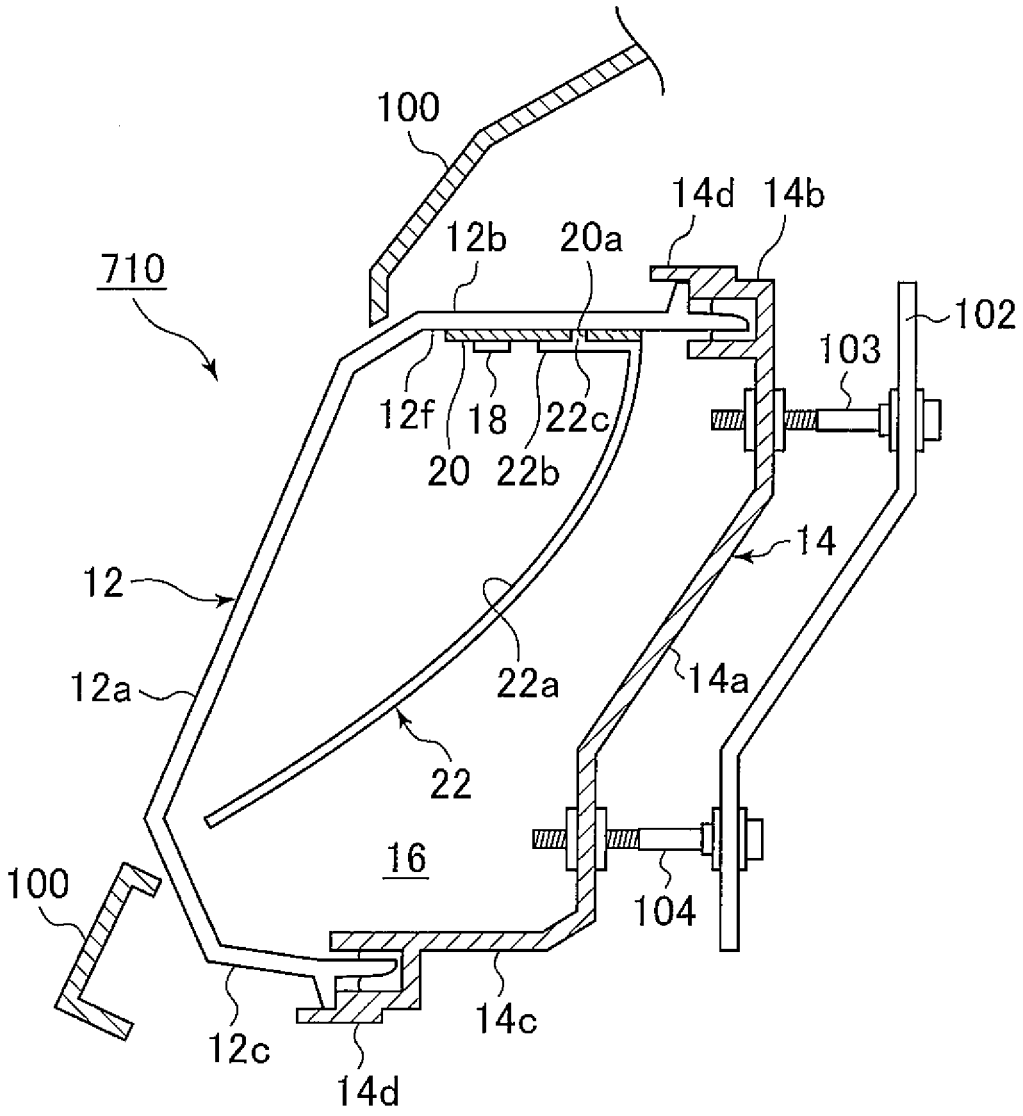
FIG. 7 is a sectional view of a transportation device lamp fixture according to still yet another example embodiment of the invention.

FIG. 7 is a sectional view of a vehicle lamp fixture 710 according to still yet another example embodiment of the invention. Constituent elements of this vehicle lamp fixture 710 that are similar or correspond to constituent elements of the vehicle lamp fixture 10 shown in FIGS. 1 and 2 will also be denoted by like reference characters and redundant descriptions of those elements will be appropriately omitted.

With the vehicle lamp fixture 710 according to this example embodiment, the circuit board 20 to which the LED 18 is mounted is attached to the inside surface 12*f* of the upper portion 12*b* of the front cover 12. The method by which the circuit board 20 is fixed to the upper portion 14*b* is not particularly limited. That is, the circuit board 20 may be fastened by a screw, fixed by adhesive, or thermally caulked, or the like.

Also, in this example embodiment, the attaching portion 22*b* of the reflector 22 is fixed on the circuit board 20. As shown in the expanded view of the main portions of the vehicle lamp fixture 710 in FIG. 7, a positioning protrusion 22*c* is formed on the attaching portion 22*b*. Inserting this positioning protrusion 22*c* into a positioning recessed portion 20*a* provided on the circuit board 20 enables the reflector 22 to be properly positioned with respect to the circuit board 20. The method by which the attaching portion 22*b* is fixed to the circuit board 20 is not particularly limited. That is, the attaching portion 22*b* may be fastened by a screw, fixed by adhesive, or thermally caulked, or the like.

With this kind of structure as well, there is no need to provide a separate member for supporting the circuit board 20, so the structure of the lamp fixture is able to be simplified. As a result, it is possible to reduce the number of parts and lower the cost, as well as make the lamp fixture lighter and smaller.

Also, the LED 18 and the reflector 22 are attached onto the circuit board 20, so the positioning accuracy of the LED 18 and the reflector 22 can be increased, and the optical precision can be improved.

Figure 8:
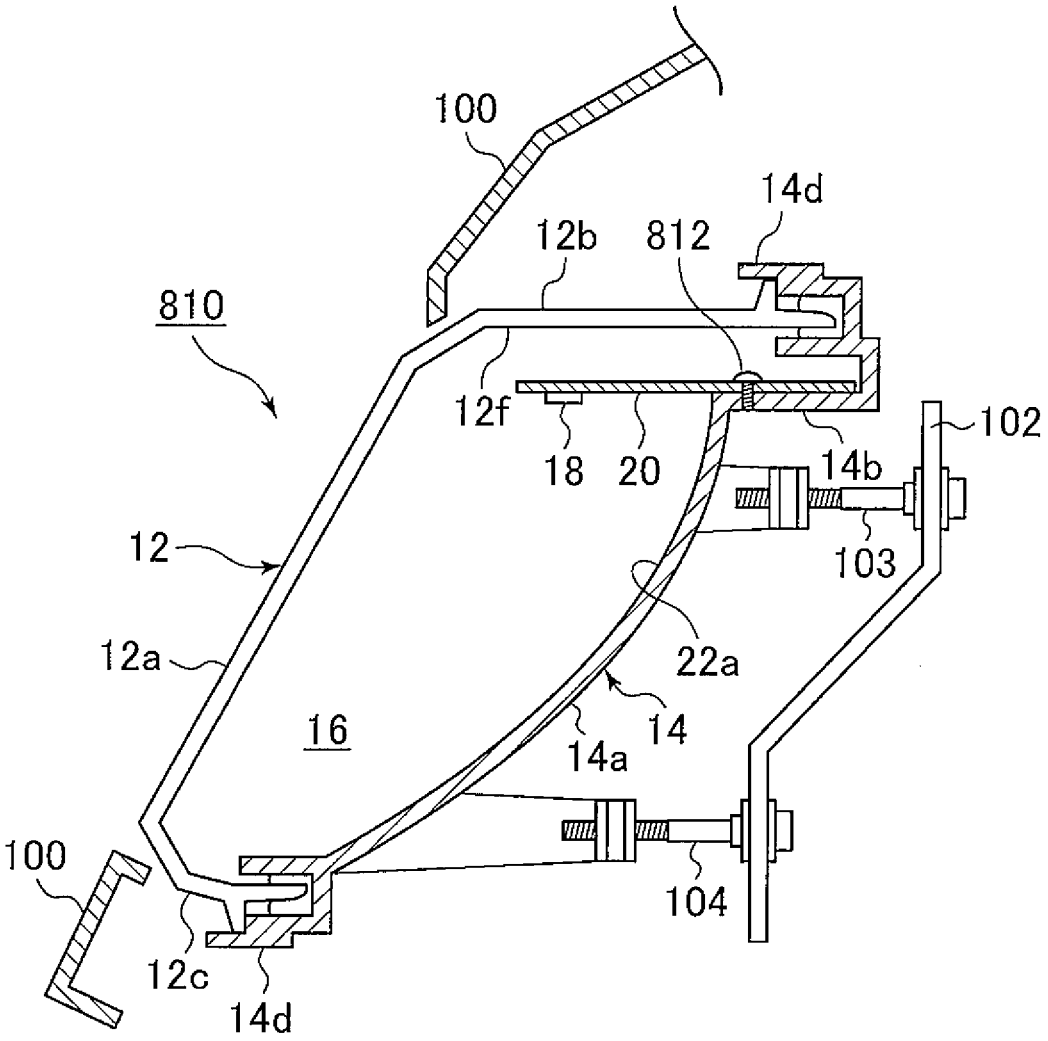
FIG. 8 is a sectional view of a transportation device lamp fixture according to another example embodiment of the invention.

FIG. 8 is a sectional view of a vehicle lamp fixture 810 according to another example embodiment of the invention. Constituent elements of this vehicle lamp fixture 810 that are similar or correspond to constituent elements of the vehicle lamp fixture 10 shown in FIGS. 1 and 2 will also be denoted by like reference characters and redundant descriptions of those elements will be appropriately omitted.

With the vehicle lamp fixture 810 according to this example embodiment, a front surface of the back portion 14*a* of the lamp body 14 is formed as the reflective portion 22*a*. That is, the back portion 14*a* of the lamp body 14 also serves as the reflector.

Also, in this example embodiment, the upper portion 14*b* extends rearward from the upper end portion of the back portion 14*a* of the lamp body 14, and the circuit board 20 is fixed to the upper portion 14*b* by a screw 812. The method by which the circuit board 20 is fixed to the upper portion 14*b* is not particularly limited. That is, the circuit board 20 may be fastened by a screw, fixed by adhesive, or thermally caulked, or the like. The circuit board 20 is brought close to the upper portion 12*b* of the front cover 12, but not so close as to interfere with the upper portion 12*b*.

With this kind of structure as well, there is no need to provide a separate member for supporting the circuit board 20, so the structure of the lamp fixture is able to be simplified. As a result, it is possible to reduce the number of parts and lower the cost, as well as make the lamp fixture lighter and smaller.

Also, the back portion 14*a* of the lamp body 14 also serves as the reflector, so the number of parts can be further reduced, and in addition, the positioning accuracy of the LED 18 and the reflective portion 22*a* can be increased, and the optical precision can be improved. Moreover, the vehicle lamp fixture 810 according to this example embodiment is also advantageous in that heat is able to be exhausted outside of the lamp chamber 16 well.

The invention has been described based on various example embodiments. However, these example embodiments are merely examples. It is understood by one skilled in the art that various modified examples are possible for combinations of various processes and the constituent elements, and that these modified examples are also included in the scope of the invention.

For example, in the example embodiments described above, an LED is used as the light source, but a semiconductor light-emitting device such as a semiconductor laser, for example, may also be used.

In the example embodiments described above, the vehicle lamp fixture of the invention is applied to a small transportation device such as a personal mobility vehicle, but the vehicle lamp fixture of the invention may also be applied to a transportation device, such as a two-wheeled vehicle or an electric vehicle, for example, in which there is no other large heat source in the position where the vehicle lamp fixture is attached.

The transportation device lamp fixture may also include a reflector that reflects light emitted from the semiconductor light-emitting device in front of the lamp fixture. The reflector may be attached to one of the front cover and the lamp body, whichever the circuit board is attached to.

In the transportation device lamp fixture described above, the reflector may include a reflective portion for reflecting the light from the semiconductor light-emitting device, and an attaching portion for attaching the reflector to the front cover or the lamp body. Also, the circuit board may be attached to the front cover or the lamp body via the attaching portion of the reflector.

In the transportation device lamp fixture described above, a heat sink may be formed on a portion of the upper portion of the front cover or the lamp body, and the circuit board may be attached to the heat sink.

The transportation device lamp fixture described above may be mounted to a transportation device that does not have another heat source that is different from the transportation device lamp fixture, and that is located around a predetermined position where the lamp fixture is attached.

In the transportation device lamp fixture described above, the circuit board may be attached to the lamp body.

In the transportation device lamp fixture described above, a front surface of the back portion of the lamp body may be formed as the reflective portion.

What is claimed is:

1. A transportation device lamp fixture comprising:
- a semiconductor light-emitting device;
- a circuit board to which the semiconductor light-emitting device is mounted;
- a lamp body; and
- a front cover that covers an opening of the lamp body,
- wherein the semiconductor light-emitting device and the circuit board are housed inside of a lamp chamber formed by the lamp body and the front cover; and
- the circuit board is directly attached to an inside surface of an uppermost wall of the front cover that delimits the extent of the lamp chamber or an inside surface of an uppermost wall of the lamp body that delimits the extent of the lamp chamber.

2. The transportation device lamp fixture according to claim 1, further comprising a reflector that reflects light emitted from the semiconductor light-emitting device in front of the lamp fixture, wherein the reflector is attached to one of the front cover and the lamp body, whichever the circuit board is attached to.

3. The transportation device lamp fixture according to claim 2, wherein
- the reflector includes a reflective portion for reflecting the light from the semiconductor light-emitting device, and an attaching portion for attaching the reflector to the front cover or the lamp body; and
- the circuit board is attached to the front cover or the lamp body via the attaching portion of the reflector.

4. The transportation device lamp fixture according to claim 1, wherein a heat sink is formed on a portion of the upper portion of the front cover or the upper portion of the lamp body, and the circuit board is attached to the heat sink.

5. The transportation device lamp fixture according to claim 1, wherein
- the circuit board is attached to the lamp body.

6. The transportation device lamp fixture according to claim 5, wherein
- a front surface of a back portion of the lamp body is formed as a reflective portion.

7. The transportation device lamp fixture according to claim 1, wherein the transportation device lamp fixture is mounted to a transportation device that does not have another heat source that is different from the transportation device lamp fixture, and that is located around a predetermined position where the lamp fixture is attached.

* * * * *